US007909437B2

(12) United States Patent
Ide et al.

(10) Patent No.: US 7,909,437 B2
(45) Date of Patent: Mar. 22, 2011

(54) LIQUID DISCHARGE HEAD

(75) Inventors: Shuichi Ide, Tokyo (JP); Mineo Kaneko, Tokyo (JP); Ken Tsuchii, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 1261 days.

(21) Appl. No.: 11/500,446

(22) Filed: Aug. 8, 2006

(65) Prior Publication Data

US 2007/0035580 A1 Feb. 15, 2007

(30) Foreign Application Priority Data

Aug. 9, 2005 (JP) ..... 2005-230843

(51) Int. Cl.
*B41J 2/05* (2006.01)

(52) U.S. Cl. ..... 347/65; 347/47; 347/63; 347/56

(58) Field of Classification Search ..... 347/47, 347/40, 65, 63, 56, 44
See application file for complete search history.

(56) References Cited

U.S. PATENT DOCUMENTS

| | | | | |
|---|---|---|---|---|
| 4,794,411 | A | 12/1988 | Taub et al. | |
| 5,164,747 | A | 11/1992 | Osada et al. | |
| 5,208,604 | A | 5/1993 | Watanabe et al. | |
| 5,343,227 | A | 8/1994 | Hirosawa et al. | |
| 5,398,053 | A | 3/1995 | Hirosawa et al. | |
| 5,402,160 | A | 3/1995 | Kadowaki et al. | |
| 5,451,989 | A | 9/1995 | Kadowaki et al. | |
| 5,512,924 | A | 4/1996 | Takada et al. | |
| 5,682,190 | A | 10/1997 | Hirosawa et al. | |
| 5,828,387 | A | 10/1998 | Wataya et al. | |
| 5,924,197 | A | 7/1999 | Murakami et al. | |
| 5,956,056 | A | 9/1999 | Kaneko et al. | |
| 6,137,510 | A | 10/2000 | Sato et al. | |
| 6,139,130 | A | 10/2000 | Takahashi et al. | |
| 6,174,049 | B1 | 1/2001 | Tachihara et al. | |
| 6,186,616 | B1 | 2/2001 | Inoue et al. | |
| 6,286,933 | B1 | 9/2001 | Murakami et al. | |
| 6,305,080 | B1 | 10/2001 | Komuro et al. | |
| 6,412,920 | B1 | 7/2002 | Matsumoto et al. | |
| 6,428,144 | B2 * | 8/2002 | Mizutani | 347/47 |
| 6,474,790 | B2 | 11/2002 | Kaneko | |
| 6,551,079 | B1 | 4/2003 | Iwata et al. | |
| 6,575,560 | B2 | 6/2003 | Kaneko et al. | |
| 6,592,202 | B2 | 7/2003 | Udagawa et al. | |
| 6,652,079 | B2 * | 11/2003 | Tsuchii et al. | 347/65 |
| 6,659,591 | B2 | 12/2003 | Sato et al. | |
| 6,688,728 | B2 | 2/2004 | Watanabe et al. | |
| 6,824,248 | B2 | 11/2004 | Tsuchii | |

(Continued)

FOREIGN PATENT DOCUMENTS

| | | |
|---|---|---|
| JP | 1-118443 | 5/1989 |

(Continued)

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A liquid discharge head includes a substrate having a plurality of energy generating elements for generating heat energy for use in discharging liquid and a plurality of nozzles provided correspondingly to the plurality of energy generating elements. Each of the nozzles includes a chamber provided with the energy generating element, a second discharge portion, and a first discharge portion. The central axis of the second discharge portion is offset from the central axis of the first discharge portion in the nozzle arrangement direction.

8 Claims, 9 Drawing Sheets

U.S. PATENT DOCUMENTS

| | | | |
|---|---|---|---|
| 6,830,317 | B2 | 12/2004 | Tsuchii et al. |
| 6,964,467 | B2 | 11/2005 | Kaneko et al. |
| 6,976,748 | B2 | 12/2005 | Yabe et al. |
| 6,984,025 | B2 | 1/2006 | Kaneko et al. |
| 6,988,786 | B2 | 1/2006 | Kaneko et al. |
| 7,077,503 | B2 | 7/2006 | Kaneko et al. |
| 2005/0140732 | A1 | 6/2005 | Oikawa et al. |
| 2006/0044350 | A1 | 3/2006 | Tsuchii |
| 2006/0119663 | A1 | 6/2006 | Tsuchii |
| 2007/0046733 | A1 | 3/2007 | Nabeshima et al. |

FOREIGN PATENT DOCUMENTS

| | | | |
|---|---|---|---|
| JP | 2-198857 | | 8/1990 |
| JP | 2004-042652 | * | 2/2004 |

* cited by examiner

FIG. 3A
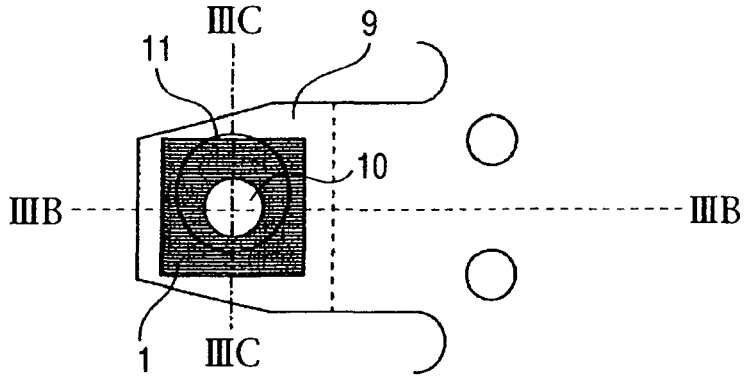
FIG. 3C
FIG. 3B
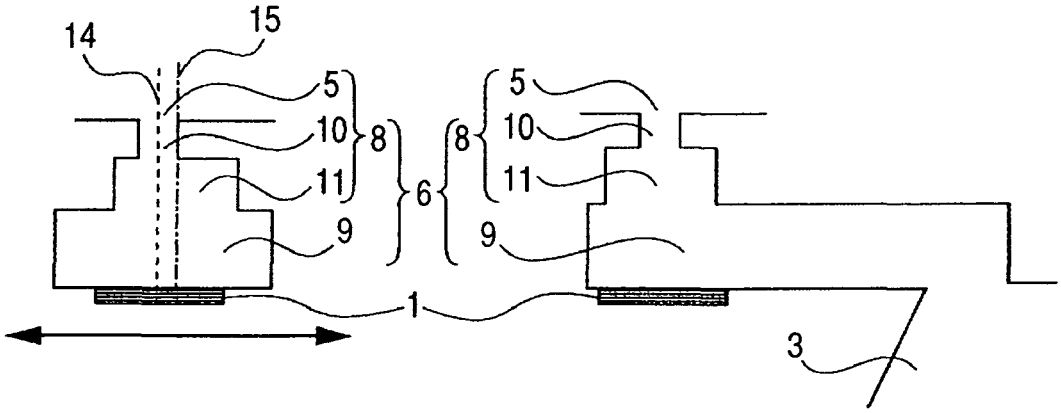
FIG. 3D
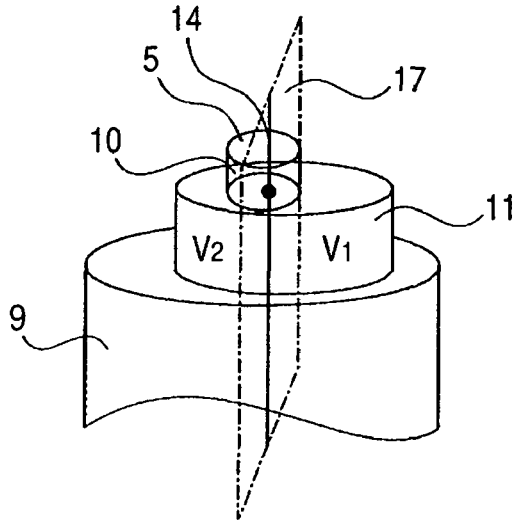

LIQUID DISCHARGE HEAD

BACKGROUND OF THE INVENTION

1. Field of the Invention

The present invention relates to a liquid discharge head for discharging liquid, and particularly to an ink jet recording head for recording by discharging ink onto a medium to be recorded.

2. Description of the Related Art

As an example of using a liquid discharge head for discharging liquid, there is an ink jet recording system for recording by discharging ink to a medium to be recorded.

Today, there are the following general ink discharge methods for use in the ink jet recording system: a method of using an electrothermal transducing element such as, for example, a heater as a discharge energy generating element for use in discharging ink droplets and a method of using, for example, a piezoelectric element. Both methods are capable of controlling the discharge of ink droplets by using electric signals.

The principle of the ink discharge method using the electrothermal transducing element is that a voltage is applied to the electrothermal transducing element to thereby bring the ink in the vicinity of the electrothermal transducing element to boil momentarily and bubbles rapidly grow owing to a phase change of the ink during the boiling to thereby discharge the ink droplets at a high speed. The ink discharge method using the electrothermal transducing element is advantageous in that there is no need to secure a large space for disposing the discharge energy generating element, the structure of the recording head is simple, and nozzles can be easily integrated.

In recent years, a desire for increasing the printing speed of color images is increasing more and more due to the speedup of processing speed of a personal computer and the spread of the Internet and digital cameras, which increases the demand for rapidly printing out a high-resolution document. Therefore, an ink jet head mounted on an ink jet printer is required to have a performance of discharging finer droplets and of providing a nozzle arrangement density of 300 dpi or more.

On the other hand, along with the decrease in size of droplets and the increase in recording density, the need for correcting a discharge state or the landing position of discharged droplets has been increased to thereby generate the need for adjusting a discharge angle into a nozzle arrangement direction. As a method of adjusting the discharge angle into a discharge port arrangement direction, there is a method of discharging droplets from a nozzle, which is oblique to a face surface of the discharge port, onto a substrate surface, as disclosed in Japanese Patent Laid-Open No. H02-198857. Furthermore, Japanese Patent Laid-Open No. H01-118443 discloses a method of adjusting a discharge angle by offsetting a discharge port with respect to a heater.

When there is a need to obtain an image having a high recording density as in recent years, however, it is often hard to form a nozzle capable of discharging liquid at a desired discharge angle in the method disclosed in Japanese Patent Laid-Open No. H02-198857.

On the other hand, in the technique disclosed in Japanese Patent Laid-Open No. H01-118443, the angle is adjusted in the supply port direction when viewed from the discharge port, which is perpendicular to the discharge port arrangement direction. If the angle is to be corrected into the discharge port arrangement direction using this method, there is a need to offset the discharge port into the discharge port arrangement direction with respect to the heater. In view of the information disclosed in Japanese Patent Laid-Open No. H01-118443, however, the problem below will occur. The effect on the discharge angle caused by offsetting the discharge port with respect to the heater decreases as the discharge aperture is reduced. Therefore, a very large offset amount is required in comparison with the conventional one to achieve a desired discharge angle when using a discharge port having a fine aperture as needed in recent years. Therefore, it is very hard to design a nozzle having such an offset amount under the condition of the 300 dpi or higher nozzle arrangement density. Furthermore, if the nozzle is designed so as to have the required offset by decreasing the nozzle arrangement density, it causes a problem that discharge efficiency drops because of an increase in the distance from a heater to a flow path wall in the offset direction.

As described hereinabove, conventionally there has not been a satisfactory method of adjusting a discharge angle of discharged droplets into a discharge port arrangement direction without decreasing the discharge efficiency in an ink jet head having a high nozzle arrangement density with a discharge port having a fine aperture.

SUMMARY OF THE INVENTION

In view of the above problems, the present invention has been provided. Therefore it is an object of the present invention to adjust a discharge angle of discharged droplets into a discharge port arrangement direction without decreasing discharge efficiency in an ink jet head having a high nozzle arrangement density with a discharge port having a fine aperture.

According to one aspect of the present invention, there is provided a liquid discharge head for discharging liquid onto a medium from nozzles while relatively scanning the medium in an opposing position to the medium, the liquid discharge head comprising: a substrate having a plurality of energy generating elements for generating heat energy for use in discharging the liquid; the plurality of nozzles provided correspondingly to the plurality of energy generating elements; and a plurality of flow paths for supplying the liquid correspondingly to the plurality of nozzles, wherein each of the nozzles includes a chamber provided with the energy generating element and a discharge portion in communication with the flow path only via the chamber, wherein the discharge portions of at least a part of the plurality of nozzles include: a first discharge portion having a discharge port for discharging the liquid; and a second discharge portion for communicating the chamber with the first discharge portion, wherein a contour of the second discharge portion includes a contour of the first discharge portion when viewed in the direction from the discharge port to the substrate and is included in a contour of the chamber; and wherein one space differs from the other space in volume in a space of the second discharge portion, which is divided by a plane that passes through the center of the discharge port and is parallel to the relative scanning direction to the medium and perpendicular to the substrate.

Further features of the present invention will become apparent from the following description of exemplary embodiments with reference to the attached drawings.

BRIEF DESCRIPTION OF THE DRAWINGS

FIGS. 3A, 3B, 3C, and 3D are explanatory diagrams for a nozzle structure of the ink jet recording head according to the present invention.

DESCRIPTION OF THE EMBODIMENTS

Figure 1:
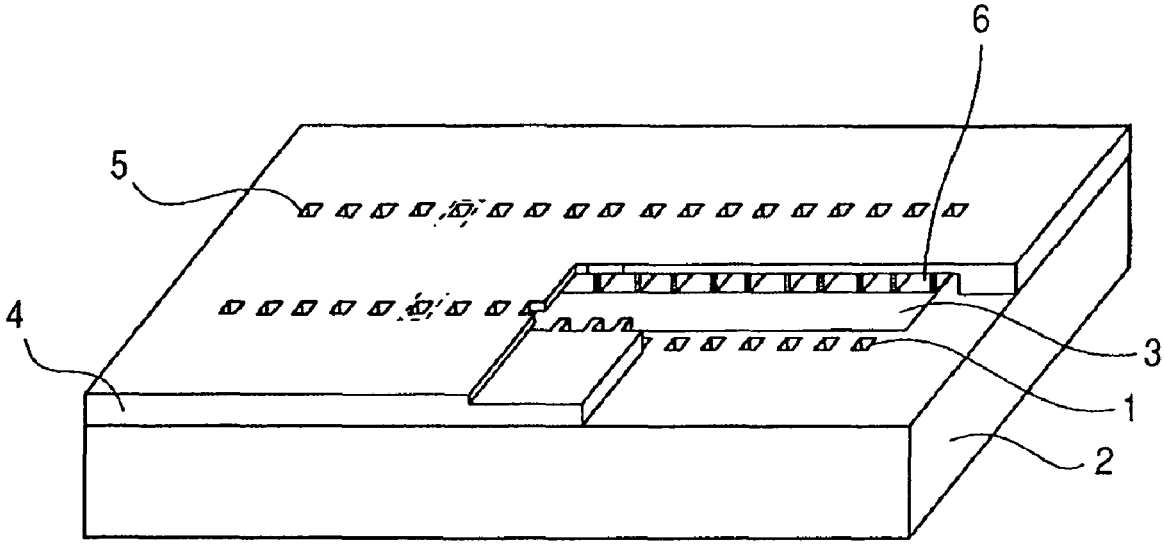
FIG. 1 is a perspective diagram showing the configuration of an ink jet recording head according to the present invention.

The preferred embodiments of the present invention will be described hereinafter with reference to accompanying drawings. In the following description, the same reference numerals refer to parts having the same function throughout the various figures with their description omitted in some cases.

While this specification describes the present invention by giving an example of an ink jet recording system as an application of the present invention, the scope of application of the present invention is not limited thereto. For example, it is also applicable to biochip fabrication, electronic circuit printing, and the like.

The following describes an ink jet recording head to which the present invention is applicable, first.

Referring to FIG. 1, there is shown a schematic diagram illustrating an ink jet recording head according to one embodiment of the present invention, which is shown with a part of the recording head cut away.

The ink jet recording head of this embodiment has a silicon substrate 2 where ink discharge energy generating elements 1 are formed in two arrays at a given pitch. The silicon substrate 2 has an ink supply port 3 formed by anisotropically etching the silicon substrate opened between the two arrays of the ink discharge energy generating elements 1. On the substrate 2, an ink flow path wall forming member 4 forms ink discharge ports 5, which open above the ink discharge energy generating elements 1, and separate ink flow paths 6 in communication with the ink discharge ports 5 from the ink supply port 3.

This ink jet recording head is positioned in such a way that the surface having the ink discharge ports 5 faces the recording surface of a recording medium. Then, a discharge pressure generated by the ink discharge energy generating elements 1 is applied to ink loaded into the ink flow paths via the ink supply port 3 to thereby discharge ink droplets from the ink discharge ports 5 so as to cause the ink droplets to attach the recording medium for recording.

This ink jet recording head can be mounted on a printer, a copying machine, a facsimile machine, a word processor, any other apparatus having a printer section, and an industrial recording apparatus compositely combined with various processors.

Figure 2:
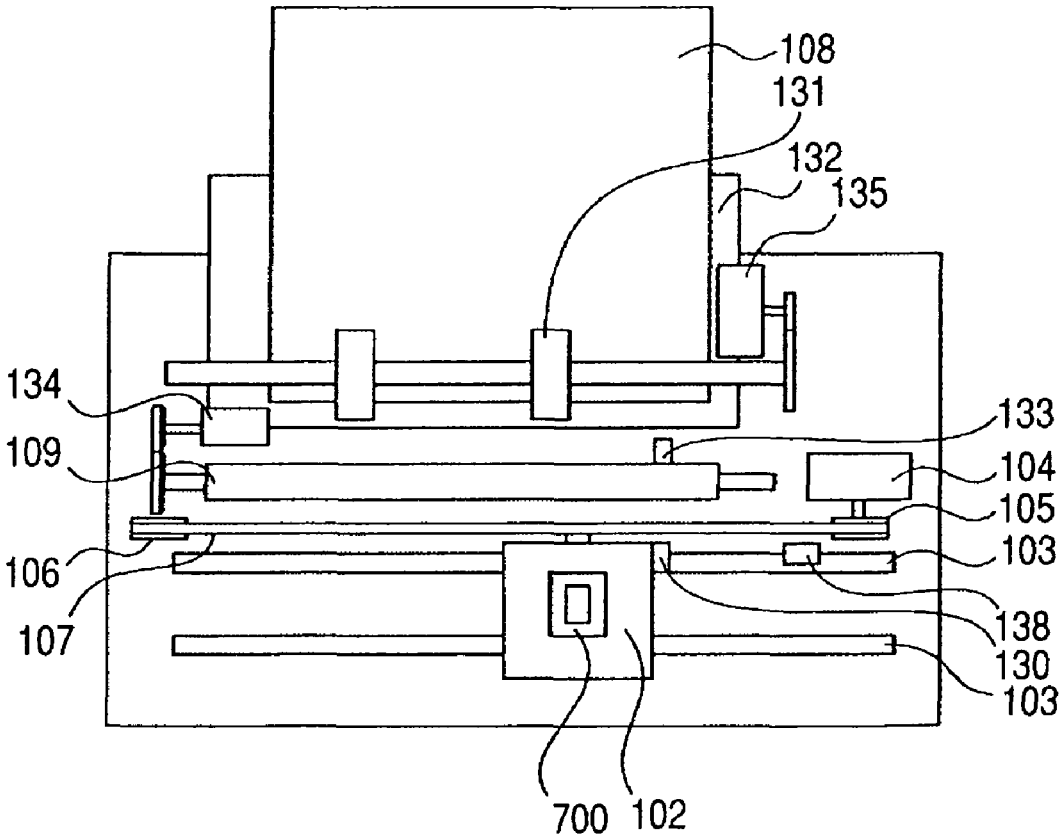
FIG. 2 is a diagram showing an example of an ink jet recording apparatus on which the ink jet recording head according to the present invention can be mounted.

Referring to FIG. 2, there is shown an explanatory diagram illustrating an example of a recording apparatus on which the ink jet recording head according to the present invention can be mounted.

In the recording apparatus shown in FIG. 2, a cartridge 700 having the recording head shown in FIG. 1 is positioned and exchangeably mounted on a carriage 102. The carriage 102 is provided with electric lines or cable for transmitting drive signals or the like to the discharge portions via an external signal input terminal on the recording head cartridge 700.

The carriage 102 is reciprocatably guided and supported along guide shafts 103 extending in the main scanning direction and placed on the apparatus body. The carriage 102 is driven by a main scanning motor 104 via a drive mechanism including a motor pulley 105, a driven pulley 106, and a timing belt 107 and its position and movement is controlled by the main scanning motor 104. In addition, a home position sensor 130 is provided on the carriage 102. Thereby, it is possible to know the position when the home position sensor 130 on the carriage 102 passes the position of a shield 138.

A recording medium 108 such as printing paper or a plastic sheet is separated and fed on a one-by-one basis from an automatic sheet feeder (ASF) 132 by rotating pickup rollers 131 via a gear from a paper feed motor 135. Furthermore, it is conveyed (sub-scanned) passing through the position (printing section) opposed to the discharge port surface of the recording head cartridge 700 by the rotation of a conveyance roller 109. The conveyance roller 109 is rotated via the gear by the rotation of an LF motor 134. In this process, the determination of whether the recording medium 108 has been fed and the confirmation of the leading edge position at the paper feed are performed when the recording medium 108 passes a paper end sensor 133. Furthermore, the paper end sensor 133 is also used to determine where the rear end of the recording medium 108 exists actually and to ultimately determine the current recording position from the actual rear end.

The recording medium 108 is supported by a platen (not shown) on the back side so that a flat printed surface is formed in the printing section. In this instance, the recording head cartridge 700 mounted on the carriage 102 is held in such a way that the discharge port surface is protruding downwardly from the carriage 102 so as to be parallel to the recording medium 108 between two pairs of the conveyance rollers.

The recording head cartridge 700 is mounted on the carriage 102 in such a way that the arrangement direction of the discharge port in each discharge portion is perpendicular to the above scanning direction of the carriage 102 and discharges liquid from the discharge array for recording.

The above recording head is used for a recording apparatus of a type in which a carriage having a recording head mounted thereon scans for printing. The ink jet recording head according to the present invention is also applicable to a so-called full-line type ink jet recording head with a nozzle array having a length corresponding to the maximum recording width of the recording medium.

Subsequently, an internal structure of the ink jet recording head according to the embodiment of the present invention will be described with reference to FIGS. 3A-3D.

Referring to FIG. 3A, there is shown a plan perspective view, viewed in the vertical direction from one of the plurality of discharge ports 5 toward the substrate 2, in the ink jet recording head according to the embodiment of the present invention shown in FIG. 1. FIG. 3B is a cross section along line IIIB-IIIB passing through the center of the discharge port in FIG. 3A. The IIIB-IIIB direction is the same as the main scanning direction in the recording apparatus shown in FIG. 2. Furthermore, FIG. 3C is a cross section along line IIIC-IIIC passing through the center of the discharge port in FIG. 3A. The IIIC-IIIC direction can be referred to as a discharge port arrangement direction in the ink jet recording head shown in FIG. 1, which is synonymous with a nozzle arrangement direction described later, and can be referred to as a sub-scanning direction in the recording apparatus shown in FIG. 2. Furthermore, FIG. 3D is a 3D perspective view of the inside of a discharge portion 8 described later.

As shown in FIGS. 3B and 3C, the ink jet recording head of the present invention is provided with a nozzle 6 for discharging ink, a supply port 3 for supplying ink to the nozzle 6, and an ink flow path 7 for communicating the supply port 3 with the nozzle 6. The nozzle 6 is composed of the discharge portion 8 including a discharge port 5, which is an orifice formed at a tip end of the nozzle, through which ink droplets are discharged, and a chamber 9 where the ink discharge energy generating element 1 is provided. The discharge portion 8 is not directly in communication with the ink flow path 7, but in communication with the ink flow path 7 only via the chamber 9. The discharge portion 8 is divided into a first discharge portion 10 including the discharge port 5 and a second discharge portion 11 positioned between and allowing communication between the first discharge portion 10 and the chamber 9. More specifically, the inside of the nozzle includes the first discharge portion 10, the second discharge portion 11, and the energy generating chamber 9 in this order in the direction from the discharge port 5 to the energy generating element. The second discharge portion 11 is connected to the first discharge portion 10 and the chamber 9 with a step, having a volume smaller than the chamber 9 and larger than the first discharge portion 10. In the plan perspective view in FIG. 3A, the second discharge portion 11 is provided outside the first discharge portion 10 and inside the chamber 9. Furthermore, as shown in FIGS. 3A and 3C, the first discharge portion 10 is a cylindrical space having a central axis 14 on a vertical line starting from the center of the discharge port 5 to the main surface of the substrate 2 and the center of the ink discharge energy generating element 1 exists on the above vertical line. Although the second discharge portion 11 is also a cylindrical space, its central axis 15 is offset in the sub-scanning direction from the central axis 14 of the first discharge portion 10. If the second discharge portion 11 is divided with the boundary of a plane (imaginary plane) 17, which is parallel to the central axis 14 of the first discharge portion 10 and to the main scanning direction, the second discharge portion 11 is divided into a space V1 large in volume on the offset side and a space V2 small in volume on the other side due to the offset of the second discharge portion 11 (FIG. 3D).

The following describes the behaviors of ink inside the nozzle during ink discharging with the ink jet recording head according to the present invention with reference to FIGS. 4A-4E.

The description will be made by giving an example of a so-called thermal ink jet system, in which a heat generating resistant element is used as the ink discharge energy generating element 1 to bring the ink to boil by the heat generated by the heat generating resistant element and the ink is discharged by the growth pressure of generated bubbles.

Referring to FIGS. 4A-4E, there is shown a schematic diagram illustrating the behaviors of a bubble 13 and ink 12 in time series during ink discharging with the ink jet recording head of the present invention, viewed from the cross section along the line IIIC-IIIC in FIG. 3A.

Figure 4A:
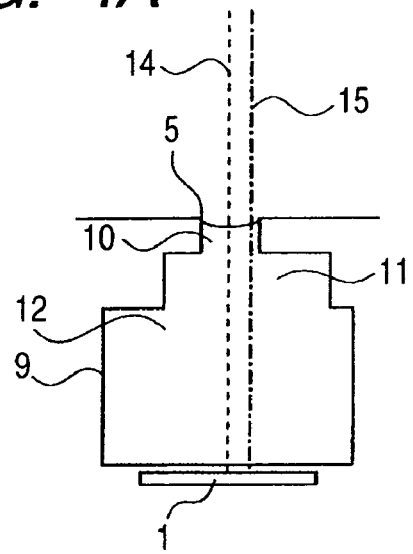
FIGS. 4A, 4B, 4C, 4D and 4E are schematic cross sections showing behaviors of ink and bubbles in time series during ink discharging in the ink jet recording head according to the present invention.
Figure 4B:
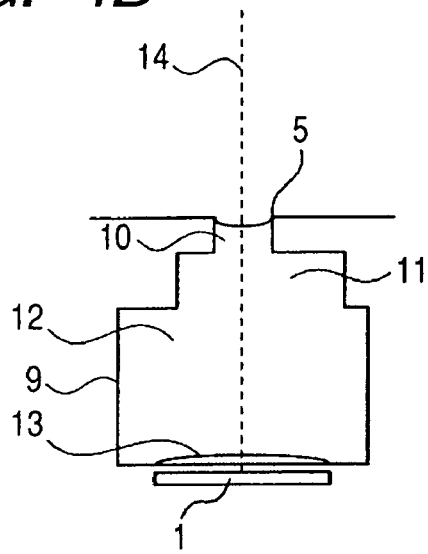
Figure 4C:
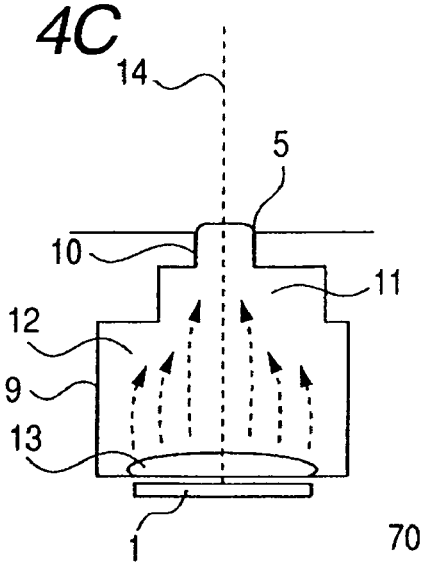
Figure 4D:
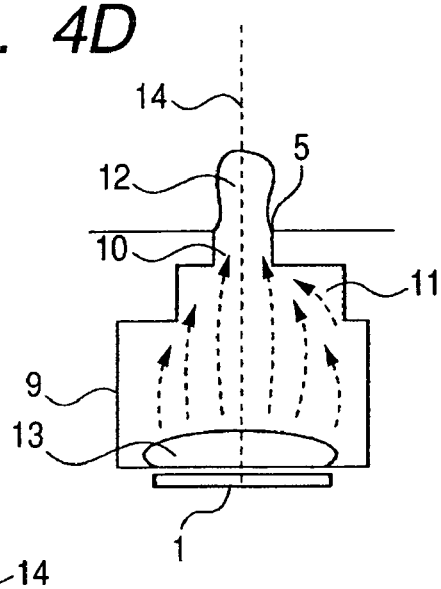
Figure 4E:
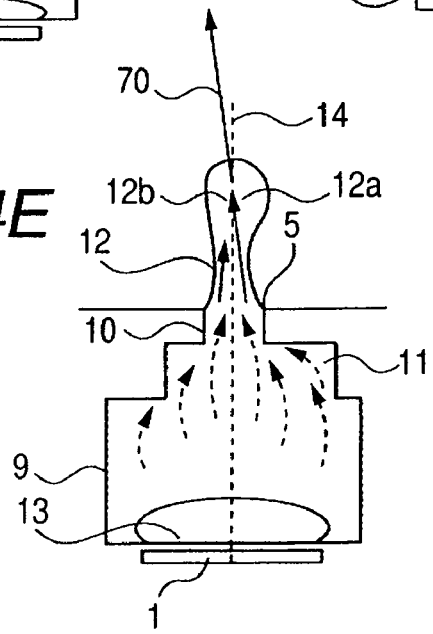

FIG. 4A shows a state before the discharge operation and FIG. 4B shows a state where the bubble 13 in the form of a film is generated on the ink discharge energy generating element 1. FIG. 4C, FIG. 4D, and FIG. 4E show the states approx. 0.5 microseconds after the state of FIG. 4B, approx. 1.0 microsecond after the state of FIG. 4B, and approx. 1.5 microseconds after the state of FIG. 4B, respectively. While reference numeral 14 in these diagrams denotes the central axis of the first discharge portion 10, the reference numeral 14 is hereinafter referred to as the central line 14 in the description using FIGS. 4A-4E.

As shown in FIG. 4B and FIG. 4C, the bubble 13 is generated in the form of a film and then grows toward the discharge port 5. In this process, the growth of the bubble 13 inside the chamber 9 is symmetrical to the central line 14 when viewed in the sub-scanning direction. The ink 12 moves toward the discharge port 5 and begins to flow symmetrically due to the growth pressure of the bubble 13.

As shown in FIG. 4D, along with the growth of the bubble 13, the ink 12 is discharged from the discharge port 5 to the outside of the nozzle. In this condition, the second discharge portion 11 has the central axis 15 offset in the sub-scanning direction from the central line 14. Therefore, both sides of the second discharge portion 11 from the plane described above differ in volume from each other. Therefore, the inflow of the ink 12 flowing from the second discharge portion 11 into the first discharge portion 10 differs between both sides of the plane 17. The inflow from the space $V_1$ on the offset side from the central line is relatively large and the inflow from the space $V_2$ on the other side is relatively small. The difference in inflow is consequently a difference in flow velocity of ink flowing into the first discharge portion 10. In the ink 12 discharged from the discharge port 5 in the state shown in FIG. 4E, ink 12*a* existing on the offset side from the central line 14 flows fast in the direction along the central line, while ink 12*b* existing on the opposite side to the offset side flows slow in the same direction. In addition, the same applies to the ink in a direction perpendicular to the central line. More specifically, the ink 12*a* flows faster than 12*b* in the component of velocity in the direction from each of the spaces to the central line. The ink 12 is more strongly affected by the ink 12*a* to thereby have momentum in the opposite direction to the offset direction in the sub-scanning direction. Therefore, the ink 12 is discharged in the direction of an arrow 70 angled in the opposite direction to the offset direction relative to the central line 14. As a result, the landing position of the ink 12 in the sub-scanning direction shifts from that under the condition where the central axis of the first discharge portion 10 is coincident with the central axis of the second discharge portion 11.

Even if an asymmetrical bias occurs in the flow of the ink 12 that is to move toward the discharge port 5 in the first discharge portion 10, however, the ink discharged from the vicinity of the discharge port 5 is never discharged at an angle to the central line 14 during discharging unless it has momentum in the sub-scanning direction. Therefore, to shift the landing position of the ink in the sub-scanning direction, it is necessary to maintain the nonuniformity of the ink flow in the sub-scanning direction, which occurs at the bottom of the first discharge portion 10, until it reaches the discharge port 5. Generally, if the first discharge portion 10 is relatively high, the nonuniform ink flow at the bottom of the first discharge portion 10 is rectified until it reaches the discharge port 5, by which the nonuniformity is lost.

The inventors have found that the nonuniformity is maintained so that a remarkable effect is achieved by defining "(discharge aperture $\phi$)/(the height h of the first discharge portion 10) >1" as shown in Table 1 as a result of consideration. The content will be described below by using diagrams.

Figure 9:
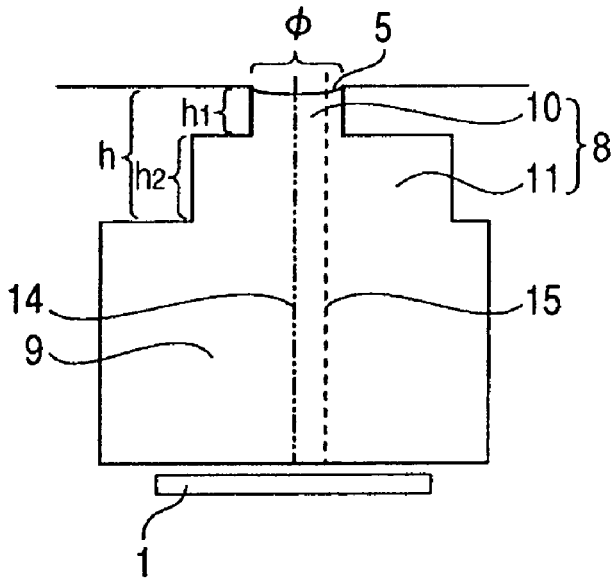
FIG. 9 is a schematic cross section showing a nozzle structure according to the embodiments of the present invention.
Figure 10:
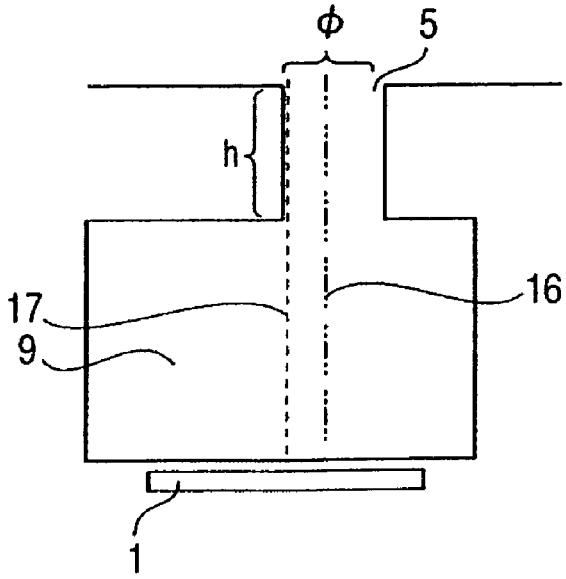
FIG. 10 is a schematic cross section showing a nozzle structure according to a comparative example of the present invention.

Referring to FIG. 9 and FIG. 10, there are shown a schematic cross section of a nozzle structure according to embodiments of the present invention and a schematic cross section of a nozzle structure according to a comparative example of the present invention. Table 1 shows effects of the discharge aperture ϕ and the heights h, $h_1$, and $h_2$ of the discharge portion, the first discharge portion, and the second discharge portion on the shift of the landing position of liquid droplets in the nozzles of first to third embodiments of the present invention and in the nozzle of a comparative example 4.

TABLE 1

| | | Embodiments | | | Comparative example |
|---|---|---|---|---|---|
| Nozzle No. | | (1) | (2) | (3) | (4) |
| h | $h_1$ | 3 μm | 5 μm | 5 μm | 5 μm |
| | $h_2$ | 5 μm | 3 μm | 3 μm | |
| ϕ | | 6 μm | 6 μm | 8 μm | 8 μm |
| r | | 3 μm | 3 μm | 3 μm | |
| Shift amount* | | Large | Small | Large | Minimum |

*Shift amount of landing position at distance of 1 mm from recording medium
Large: 8 μm or more
Middle: 3 μm to 8 μm
Small: 1 μm to 3 μm
Minimum: 1 μm or less In the nozzles described in the first to third embodiments, the height h of the discharge portion 8 is 8 μm. On the other hand, the nozzle of the comparative example 4 has no second discharge portion in the discharge portion 8. As shown in FIG. 9, the offset amount r between the central axis 14 of the first discharge portion, namely the center of the ink discharge energy generating element 1 and the central axis 15 of the second discharge portion 11 is 3 μm in the nozzles described in the first to third embodiments. On the other hand, as shown in FIG. 10, a vertical line 16 from the center of the discharge port to the substrate is offset from a central axis 17 of the ink discharge energy generating element 1 with the 3 μm offset in the nozzle of the comparative example 4. By comparing the nozzle of the first embodiment with the nozzle of the second embodiment, it is understood that the shift amount becomes smaller if the height of the first discharge portion 10 increases. By comparing the nozzle of the second embodiment with the nozzle of the third embodiment, it is understood that the shift amount becomes large as the discharge aperture increases under the condition that the height of the first discharge portion 10 is constant. On the other hand, the shift amount of the nozzle in the comparative example 4 is minimum, by which it is understood that the shift of the landing position is remarkably affected by the offset of the second discharge portion 11.

The preferred embodiments of the present invention will be described hereinafter for more detailed description of the present invention.

First Embodiment

The first embodiment of the present invention will be described with reference to FIG. 5.

Figure 5:
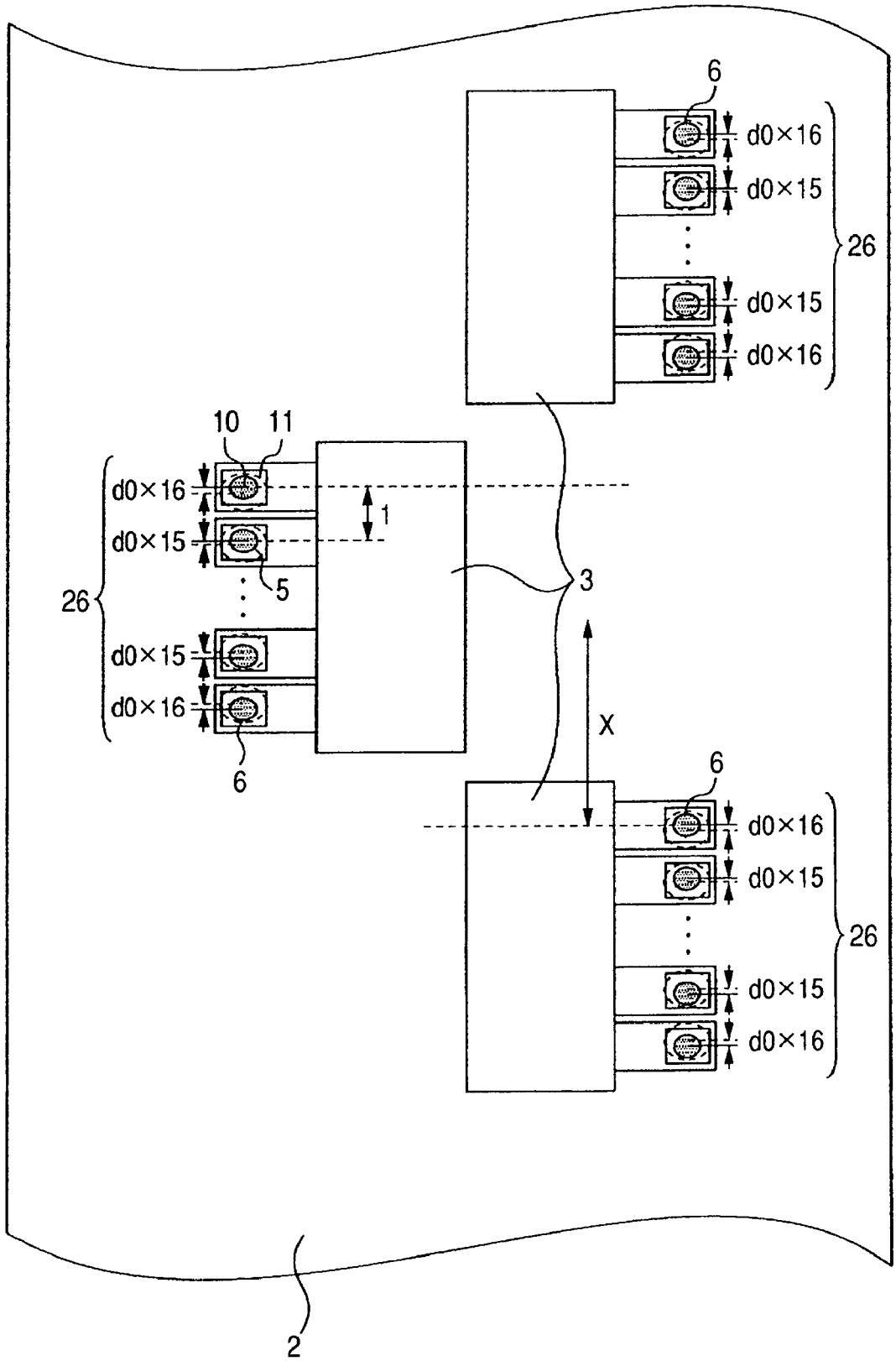
FIG. 5 is a diagram showing a nozzle arrangement according to a first embodiment of the present invention.

Referring to FIG. 5, there is shown the nozzle arrangement of an ink jet recording head in the first embodiment of the present invention.

The arrangement of this embodiment is preferably applicable to the ink jet recording head in which the ink supply port is divided within the nozzle arrangement.

Along with the increase of nozzles for achieving a high picture quality and a high processing speed required for the ink jet recording head in recent years, the length of the supply port in the nozzle arrangement direction increases. This causes a possibility of decreasing the strength of the entire substrate, and therefore it is conceivable to divide the supply port in the arrangement. It is impossible, however, to dispose a nozzle between supply ports adjacent to each other, which may lead to a problem in an image.

In the arrangement of this embodiment, the nozzles 6 exist only on one side of each ink supply port 3 and a nozzle array 26 consisting of 32 nozzles 6 exists in each ink supply port 3. The nozzles 6 are arranged at intervals of 1 (=38.3) μm and the end nozzles of ink supply ports 3 adjacent to each other are spaced from each other by×(=128) μm.

The center of the second discharge portion 11 is offset from the center of the first discharge portion 10 by an integral multiple of d0 (=0.075 μm) in the direction from the center of the nozzle array 26 toward its ends (in the sub-scanning direction) (if there are an odd number of nozzles in each ink supply port, the offset amount between the discharge port 5 and the second discharge portion 11 is zero only in the nozzle existing at the center of the nozzle array), so that the offset amount increases toward the ends of the ink supply port 3.

Note here that the discharge port 5 of each of the arranged nozzles 6 has a diameter of 11 μm and the second discharge portion 11 has a diameter of 20 μm in this embodiment. The first discharge portion 10 has a height of 3 μm and the second discharge portion 11 has a height of 5 μm in all nozzles.

The center of the first discharge portion 10 is shifted 2.5 μm from the center of the second discharge portion 11 regarding the nozzles 6 at both ends of the ink supply port under the above conditions. If the face surface of the discharge port 5 is 1.0 mm apart from paper as a recording medium in the above condition, a liquid droplet discharged from the end discharge port lands in a position shifted from the center of the discharge port by approx. 42 μm in the outward direction. Therefore, the liquid droplets can be discharged in the area between the supply ports at substantially the same landing intervals as in the nozzle array area.

As a result, it becomes possible to achieve an ink jet recording head having substantially the same performance as in the case where the nozzles 6 are arranged at intervals of 600 dpi when viewed in the main scanning direction. With an application of the present invention, the same effect as in the ink jet recording head having nozzles between adjacent ink supply ports can be achieved also in an ink jet recording head having a plurality of ink supply ports 3 within the nozzle arrangement.

Second Embodiment

The second embodiment of the present invention will be described below with reference to FIGS. 6A to 6C and FIG. 7.

This embodiment is suitable for means for correcting so-called end misalignment in which a droplet discharged from the nozzle located in the vicinity of the end of the nozzle array heads for the center of the nozzle array, thereby changing the trajectory of the liquid droplet due to an effect of an air flow generated by discharged droplets.

Figure 6A:
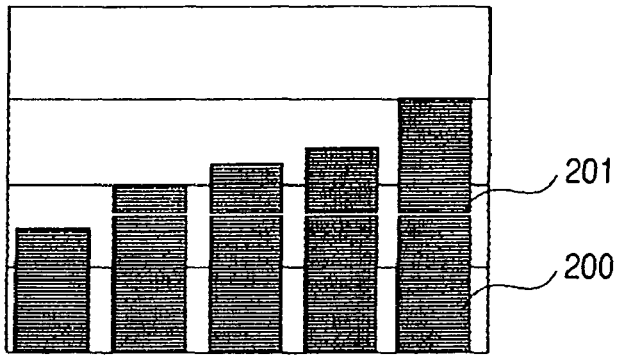
FIGS. 6A, 6B, and 6C are diagrams showing an example of an ink discharge state and solid images during solid printing using a conventional ink jet recording head.

First, the end misalignment will be described below. If ink droplets are discharged continuously from all discharge ports of the ink jet recording head to perform so-called solid printing on a recording medium, a streak 201 may occur in some cases, for example, in painted areas of a bar graph as shown in FIG. 6A, namely in the image of solid printed areas 200. The streak 201 just corresponds to the boundary between the nth operation and the (n+1)th operation.

Figure 6B:
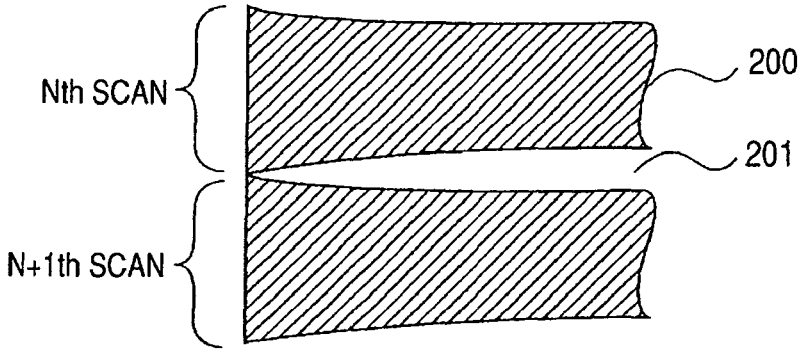
Figure 6C:
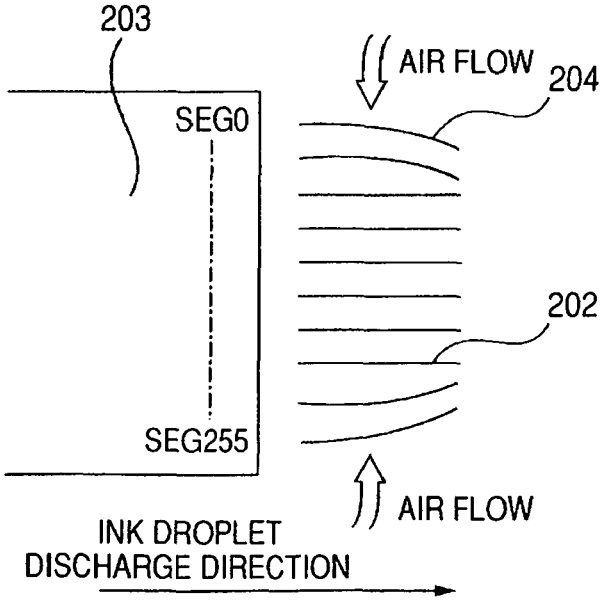

FIG. 6B shows the enlarged boundary portion and FIG. 6C shows the state where ink droplets 202 are discharged from the head 203. If the image data is for solid printing, all of the nozzles from SEG 0 to SEG 255 are driven at a high response frequency. The black arrow in FIG. 6C indicates the direction in which ink droplets are discharged during the drive operation. Therefore, the air having a certain viscosity around the discharged ink droplets also moves along with the motion of the ink droplets. This increases the tendency of the reduced pressure in the vicinity of the discharge port surface where the discharge ports of the ink jet recording head open, relative to the surrounding of the print head. Thereby, the surrounding air flows into the reduced pressure area in the form of an air flow as indicated by an outline arrow. Due to the effect of the air flow, particularly the ink droplets 204 discharged from the discharge ports at both ends of the discharge port arrangement are drawn toward the center of the arrangement. In other words, the ink droplets 204 are ejected inward and are not discharged in the desired positions of the recording medium. This causes the problem that the landing position is shifted to thereby generate the streak 201 as shown in FIG. 6B in some cases.

The ink jet recording head in this embodiment aims to reduce the effect of the end misalignment by correcting the landing position by discharging the ink droplets at a discharge angle in the direction of outward ejection opposite to the direction of the inward ejection described above.

Figure 7:
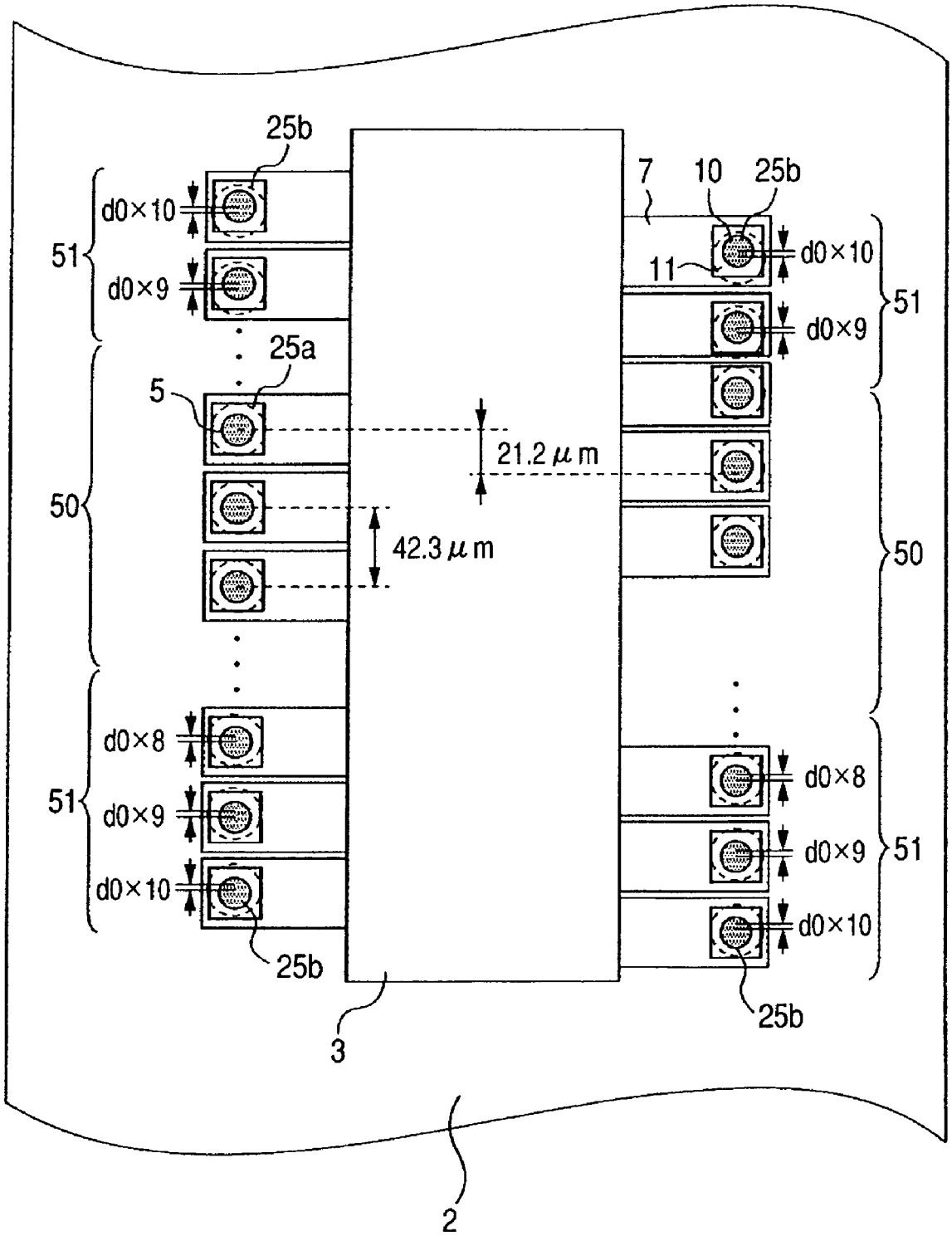
FIG. 7 is a diagram showing a nozzle arrangement according to a second embodiment of the present invention.

Referring to FIG. 7, there is shown the nozzle arrangement of the ink jet recording head according to the second embodiment of the present invention. In the nozzle arrangement of the ink jet recording head according to this embodiment, nozzle arrays are disposed on both opposite sides of a supply port and each nozzle array includes a first nozzle array 50 and a second nozzle array 51. The first nozzle array 50 includes first nozzles 25*a* disposed at intervals of 600 dpi (42.3 μm). The second nozzle array 51 includes second nozzles 25*a*' disposed at the same intervals (42.3 μm), with the center of each second discharge portion 11 of the nozzles 25*a*' offset from the center of the first discharge portion 10 in the sub-scanning direction. The entire nozzle array is formed of the first nozzle array 50 disposed between two second nozzle arrays 51.

More specifically, in the nozzle arrangement show in FIG. 7, up to ten nozzles counted in the direction of the center of the nozzle array from end nozzles 25*b* of each nozzle array disposed on both ends of the supply port are arranged as the second nozzle arrays 51 in which the offset interval between the center of the first discharge portion 10 and the center of the second discharge portion 11 is set to an integral multiple of d0 (=0.1 μm). The offset direction is along the nozzle array (the sub-scanning direction) and is the direction toward the ends of the nozzle array when viewed from the center of the nozzle. Furthermore, the offset amount increases toward the ends of the nozzle array.

Note here that the discharge port 5 has a diameter of 11 μm and the second discharge portion 11 has a diameter of 20 μm in this embodiment. The first discharge portion 10 has a height of 3 μm and the second discharge portion 11 has a height of 5 μm. More specifically, the center of the first discharge portion 10 is shifted 1 μm from the center of the second discharge portion 11 regarding the end nozzles at both ends of the nozzle array. If the face surface of the discharge port is 1.0 mm apart from paper in this condition, a liquid droplet discharged from the end nozzle lands in a position further shifted by approx. 10 μm in the outward direction in comparison with the case where the center of the second discharge portion 11 is coincident with the center of the first discharge portion 10.

As described above, it is possible to correct the end misalignment of liquid droplets that occurs during solid printing and to bring the liquid droplets to land in a desired position by previously ejecting the droplets outwardly by means of the ink jet recording head having the configuration of this embodiment.

In this embodiment, the offset varies with each nozzle and the offset increases toward the ends of the nozzle array. Even if the offset of each nozzle is constant, however, the effect of correcting the end misalignment can be achieved only if the second discharge portion is offset in the nozzles disposed at both ends of the nozzle array and in the vicinity thereof where the end misalignment occurs.

Third Embodiment

The third embodiment of the present invention will be described below with reference to FIG. 8.

Figure 8:
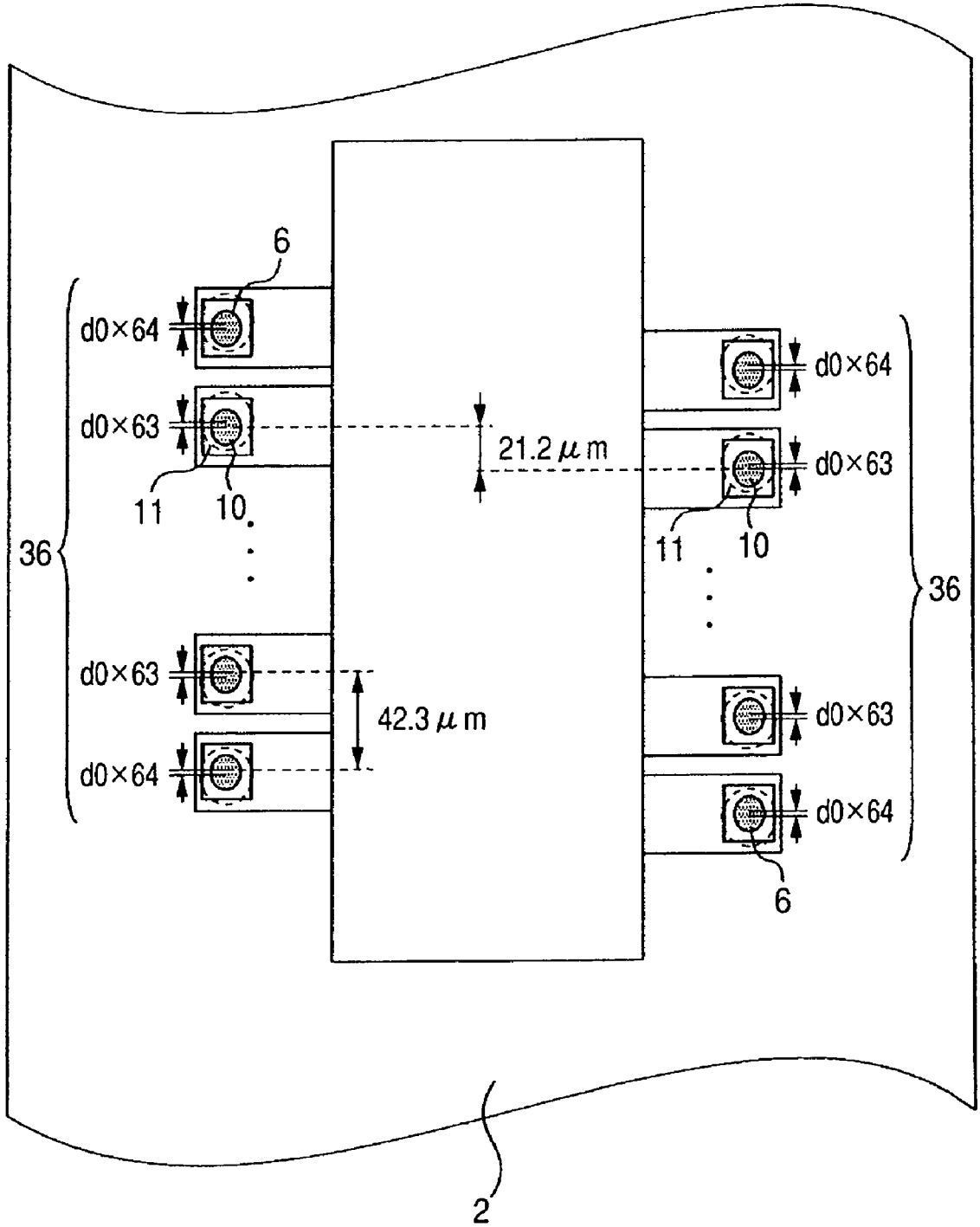
FIG. 8 is a diagram showing a nozzle arrangement according to a third embodiment of the present invention.

Referring to FIG. 8, there is shown a nozzle arrangement of the ink jet recording head according to the third embodiment of the present invention. This embodiment is preferably applicable to a case of recording at the different landing intervals from the nozzle arrangement intervals in the ink jet recording head.

In the nozzle arrangement shown in FIG. 8, 128 nozzles are arranged at regular intervals in one nozzle array 36. Each second discharge portion 11 is offset by an integral multiple of d0 from the center of each first discharge portion 10 in the direction from the center of the nozzle array 36 toward its ends. The offset direction is from the ends of the nozzle array 36 toward the center thereof. With this nozzle arrangement, it becomes possible to discharge ink at a discharge angle even if it is hard to reduce the nozzle pitch due to the circuit limits and thus to reduce the landing pitch independently of the nozzle pitch.

The above description has been made by using the embodiments in which the center of the ink discharge energy generating element 1 exists on the central axis 14 of the first discharge portion 10. The center of the ink discharge energy generating element 1, however, does not always need be on the central axis 14 of the first discharge portion 10. As shown in FIG. 3D, if the second discharge portion 11 is divided with the plane 17 as a boundary and the divided spaces differ in volume from each other, the desired effect can be achieved even if the center of the ink discharge energy generating element 1 does not exist on the central axis 14 of the first discharge portion 10.

While the present invention has been described with reference to exemplary embodiments it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-230843, filed Aug. 9, 2005, which is hereby incorporated by reference herein in its entirety.

What is claimed is:

1. A liquid discharge head for discharging liquid onto a medium while relatively scanning the medium in a position opposed to the medium, the liquid discharge head comprising:

a substrate having a plurality of energy generating elements for generating heat energy for use in discharging the liquid;

a plurality of nozzles provided in a row correspondingly to the plurality of energy generating elements; and a plurality of flow paths for supplying the liquid correspondingly to the plurality of nozzles, wherein each of the nozzles includes a chamber provided with a corresponding energy generating element and a discharge portion in communication with a corresponding flow path only via the chamber, wherein the discharge portion of at least one nozzle of the plurality of nozzles includes a first discharge portion having a discharge port for discharging the liquid, and a second discharge portion for communicating the chamber with the first discharge portion, wherein a contour of the second discharge portion includes a contour of the first discharge portion when viewed in the direction from the discharge port to the substrate and is included in a contour of the chamber; and wherein when the second discharge portion is divided into two spaces by a plane that passes through the center of the discharge port, is perpendicular to the direction along the row of nozzles, and is perpendicular to the substrate, one of the two spaces differs in volume from the other of the two spaces.

2. A liquid discharge head according to claim 1, wherein a flow velocity of the liquid flowing into the first discharge portion from a larger volume space of the two spaces divided by the plane in the second discharge portion is higher than a flow velocity of the liquid flowing into the first discharge portion from a smaller volume space during a phase when a bubble generated in the liquid by the heat energy grows.

3. A liquid discharge head according to claim 1, wherein $\phi/h \geqq 1$ is satisfied, where $\phi$ is a diameter of the discharge port and h is a height of the first discharge portion.

4. A liquid discharge head according to claim 1, further comprising a plurality of supply ports for supplying the flow paths with the liquid, wherein the plurality of flow paths are in communication with one of the plurality of supply ports.

5. A liquid discharge head comprising:

a substrate having a plurality of energy generating elements for generating energy for use in discharging liquid;

a plurality of nozzles provided in a row on the substrate correspondingly to the plurality of energy generating elements; and a plurality of flow paths for supplying the liquid correspondingly to the plurality of nozzles, wherein each of the nozzles includes a chamber provided with a corresponding energy generating element, and a discharge portion in communication with a corresponding flow path only via the chamber, wherein the discharge portion of at least one nozzle of the plurality of nozzles includes a first discharge portion having a discharge port for discharging the liquid, and a second discharge portion for communicating the chamber with the first discharge portion, wherein a contour of the second discharge portion includes a contour of the first discharge portion when viewed in a direction from the discharge port to the substrate and is included in a contour of the chamber, and wherein the center of the first discharge portion is coincident with the center of the chamber and the second discharge portion is offset relative to the chamber in a direction along the row of nozzles.

6. A liquid discharge head according to claim 5, wherein a nozzle whose second discharge portion is offset is provided at each end of the row of nozzles.

7. A liquid discharge head according to claim 5, wherein nozzles of the plurality of nozzles, each of whose second discharge portion is offset, are disposed in such a way as to be adjacent to each other and the offset of each of the second discharge portions is the same among the nozzles.

8. A liquid discharge head according to claim 5, wherein each of the plurality of nozzles has the second discharge portion that is offset and the offset amounts of the second discharge portions vary gradually in a direction from a central nozzle of the row of nozzles toward an end nozzle.

* * * * *